US006532608B2

(12) United States Patent
Schreiner

(10) Patent No.: US 6,532,608 B2
(45) Date of Patent: Mar. 18, 2003

(54) FITTED TOP BED SHEET

(75) Inventor: David N. Schreiner, Anjou (CA)

(73) Assignee: Med-I-Pant (CA)

( * ) Notice: Subject to any disclaimer, the term of this patent is extended or adjusted under 35 U.S.C. 154(b) by 0 days.

(21) Appl. No.: 09/803,417

(22) Filed: Mar. 9, 2001

(65) Prior Publication Data

US 2001/0032361 A1 Oct. 25, 2001

(51) Int. Cl.[7] ..... A47G 9/02
(52) U.S. Cl. ..... 5/497; 5/485
(58) Field of Search ..... 5/497, 494, 495, 5/499, 482, 485

(56) References Cited

U.S. PATENT DOCUMENTS

| | | | | | |
|---|---|---|---|---|---|
| 2,605,483 | A | * | 8/1952 | Ridenhour | 5/497 |
| 2,697,056 | A | * | 5/1954 | Simpson | 5/485 |
| 2,695,414 | A | * | 11/1954 | Ford et al. | 5/485 |
| 2,772,425 | A | * | 12/1956 | Brodie | 5/485 |
| 2,788,532 | A | * | 4/1957 | Christley | 5/497 |
| 3,090,052 | A | * | 5/1963 | Goldsmith | 5/485 |
| 3,181,179 | A | * | 5/1965 | Roddey, Jr. | 5/497 |
| 3,273,175 | A | * | 9/1966 | Anderson et al. | 5/497 |
| 3,438,068 | A | * | 4/1969 | Anderson et al. | 5/497 |
| 4,308,626 | A | * | 1/1982 | Weiss | 5/485 |
| 5,027,460 | A | * | 7/1991 | Honig | 5/497 |
| 5,042,098 | A | * | 8/1991 | Stultz | 5/497 X |
| 5,165,128 | A | * | 11/1992 | Honig | 5/497 |
| 5,189,744 | A | * | 3/1993 | Roberts | 5/497 |
| 5,884,349 | A | * | 3/1999 | Gretsinger | 5/494 X |
| 6,122,782 | A | * | 9/2000 | Chedid | 5/495 |
| 2001/0032361 | A1 | * | 10/2001 | Schreiner | 5/497 |

FOREIGN PATENT DOCUMENTS

| | | | | |
|---|---|---|---|---|
| EP | 0208557 | * | 1/1987 | 5/497 |

OTHER PUBLICATIONS

Photograph which represents one of the corners of a prior art bed sheet.

* cited by examiner

*Primary Examiner*—Robert G. Santos
(74) *Attorney, Agent, or Firm*—Webb Ziesenheim Logsdon Orkin & Hanson, P.C.

(57) ABSTRACT

A fitted top sheet for a bed has pockets for receiving a mattress at a toe end of the sheet, and a transverse pleat or flap at the toe end for accommodating the user's feet. The pleat and the mattress pocket are formed form a single notch cut into each corner of the toe end of the sheet, with the opposed sides of each notch joined together with a single seam extending the length of the notch. The seam may be formed from a line of stitching of a contrasting color from the sheet body, to form a visual indicator to readily identify the upper or lower sides of the sheet. The sheet is fabricated by a method of cutting a notch into the two lower toe corners of the sheet, with the notch having an interior, relatively steep region, merging with a peripheral relatively shallow region.

20 Claims, 3 Drawing Sheets

FITTED TOP BED SHEET

FIELD OF THE INVENTION

The present invention relates to bed sheets, and in particular a top sheet which includes a pleated portion or flap to accommodate a users feet and terminal pockets to permit the sheet to be fitted and retained on a mattress. The invention also relates to an arrangement in a sheet for readily and conveniently ensuring that the sheet is installed right side up.

BACKGROUND OF THE INVENTION

Fitted top sheets are employed in a variety of institutional and non-institutional settings, such as hospitals, nursing homes and the like. They provide the dual advantages of permitting rapid sheet changes, thereby reducing labour costs, and being better retained on a bed than a conventional flat sheet, thereby providing enhanced comfort and effectiveness. A fitted top sheet operates on a similar principal as a fitted bottom sheet, namely by providing corner pockets which are fitted over the corners of a mattress. In the case of a top sheet, the pockets are provided only at one end of the sheet, namely the foot end. The head end of the sheet generally resembles a conventional flat sheet. Conveniently, the sheet may be fabricated from an elastic fabric, for example a knitted fabric such as cotton having elastic fibers incorporated into the fabric to provide a suitable degree of elasticity. Elasticity of the fabric permits use with a range of mattress thicknesses, and further provides an enhanced level of comfort to the user.

A fitted top sheet must be contoured to tightly fit over the end of the bed, by way of providing a relatively snug fit between the terminal sheet pockets and the corresponding mattress corners. However, the sheet must also provide a suitable amount of toe room for the user. Thus, there must be an amount of loose fabric at the foot end, to permit the sheet to billow at the foot end for movement of the user's feet. If a sheet provides insufficient slack fabric at the foot end, the user's feet may be immobilized or pressed down by the top sheet. Thus, if a sheet is tucked in overly tightly at the toe end, the constant pressure of the sheet bearing down on the user's feet can result in a medical condition called "foot drop". It is also desirable to provide sufficient loose fabric at the toe end to provide sufficient room under the sheet for the insertion of a foot cradle between the sheets at the toe end. This device lifts the sheets completely off the patient's feet, for assorted therapeutic reasons.

Conventional fitted top sheets, such as the type sold under the "Sleep-Knit"(™) brand, feature end pockets for receiving a mattress, and a notch at each corner of the foot end of the sheet which when stitched together in the finished sheet forms a flap or pleat extending across the foot end of the sheet. The flap provides a region of loose fabric at the foot end to permit the sheet to billow. These two features are provided in the prior art product by means of separate seams for each of the corner pocket and flap. Additionally, during assembly of these prior art sheets, it is necessary to provide a separate notch within the fabric to create each of the pocket and billow, as well as a third notch between the first two notches, to indicate to the fabricators where to place the seams for sewing the sheet together. Prior art sheets are thus relatively complex and time consuming to fabricate.

In a further aspect, bed sheets and in particular fitted bed sheets such as top sheets, should be installed right side up for optimum performance. Typically, sheeting fabric, and in particular knit fabric of the type which may form fitted bed sheets, has a relatively smooth side which contacts the user. It is not always readily apparent which side is to face up and which faces down when making up a bed. Thus, it is useful to provide a means to readily signal this information, in order to both improve user comfort and to speed up the bedmaking process.

SUMMARY OF THE INVENTION

It is an object of the present invention to provide a fitted top sheet for a bed, which provides in a simplified fabrication, terminal pockets for receiving a mattress at a foot end of the sheet, and a contoured region which when installed on a bed provides a region of slack fabric at the foot end of the bed.

It is a further object to provide a visual indicator, which indicates either or both of the upper or lower faces of the sheet, to facilitate use of the sheet when making up a bed.

In accordance with the above objects, the present invention consists in one aspect of a fitted top sheet for a bed, of the type comprising a sheet body having a toe end and a head end, corner pockets at the toe end to accommodate a mattress, and a pleat region of the sheet body extending transversely across the sheet body at said toe end to accommodate the feet of a user. The invention resides in the improvement wherein the corner pockets and pleat are both formed on each side of the sheet body from a single deep notch-shaped recess in the sheet body. A notch is formed at each toe end corner of said sheet body, with a first notch on one lateral side of said sheet and a second notch on a second lateral side. Each notch has a narrow inner region and a widely flared peripheral region, the sides of each notch being joined together by a single seam extending the length of the notch.

Preferably, the inner region of each notch is relatively deep and narrow with substantially straight sides merging at the mouth of said inner region with outwardly flared, curved sides, said mouth of said inner region joining with said peripheral region of said notch which comprise generally straight sidewalls diverging away from each other at a relatively broad, shallow angle.

Preferably, the opposed sides of the notch are dissimilar, wherein the mouth of said inner region is formed from a first relatively sharply curved side and second less sharply curved side of said notch.

In another aspect, a seam forms a visual indicator to indicate to the user the upper or lower side of said sheet, said visual indicator comprising the line of stitching being formed from a thread of a contrasting colour relative to the sheet body.

In a further aspect, the invention comprises a method for fabricating a fitted top sheet for a bed, comprising the steps of:

- providing a fabric blank having a generally rectangular shape, having a foot end and a head end at opposed ends thereof;
- cutting at each corner of the toe end of the fabric blank, a notch-shaped recess defined by an interior, relatively steeply angled region, merging with a peripheral, relatively shallow-angled region;
- stitching together the opposed sides of each said recess with a single seam extending the length of said recess, thereby forming within the fabric blank, a mattress pocket at each toe end corner and a transverse pleat at said toe end to accommodate the feet of a user.

Preferably, the shape of the notch is as described above.

DETAILED DESCRIPTION OF THE PREFERRED EMBODIMENT

Referring to the Figures, a fitted top sheet 10 according to the present invention is fabricated from a knit fabric having a suitable degree of elasticity, which preferably will fall within the range which is conventional for institutional bed sheetings. It will be seen that in an alternative arrangement, the fabric may be generally non-elastic, but provided with an elasticized cuff (not shown) at the terminal end, in the manner of a conventional fitted bottom sheet. However, the use of elasticized knit fabric for the entire sheet is preferred within institutional settings such as hospitals, nursing homes and the like.

At the toe end 12 of the sheet, mattress pockets 14 are formed at each corner of the sheet, for receiving therein a conventional mattress. The elasticity of the sheet permits the sheet to perform with a range of mattress thicknesses and widths.

In a further aspect, the sheet incorporates a flap or pleat 18 at the toe end, which when the sheet is fitted on to a bed accommodates a user's feet and any optional therapeutic equipment such as a foot cradle. The flap or pleat extends transversely across the toe end of the sheet and incorporates sufficient loose fabric to accommodate a range of foot sizes and conventional medical equipment.

Figure 1:
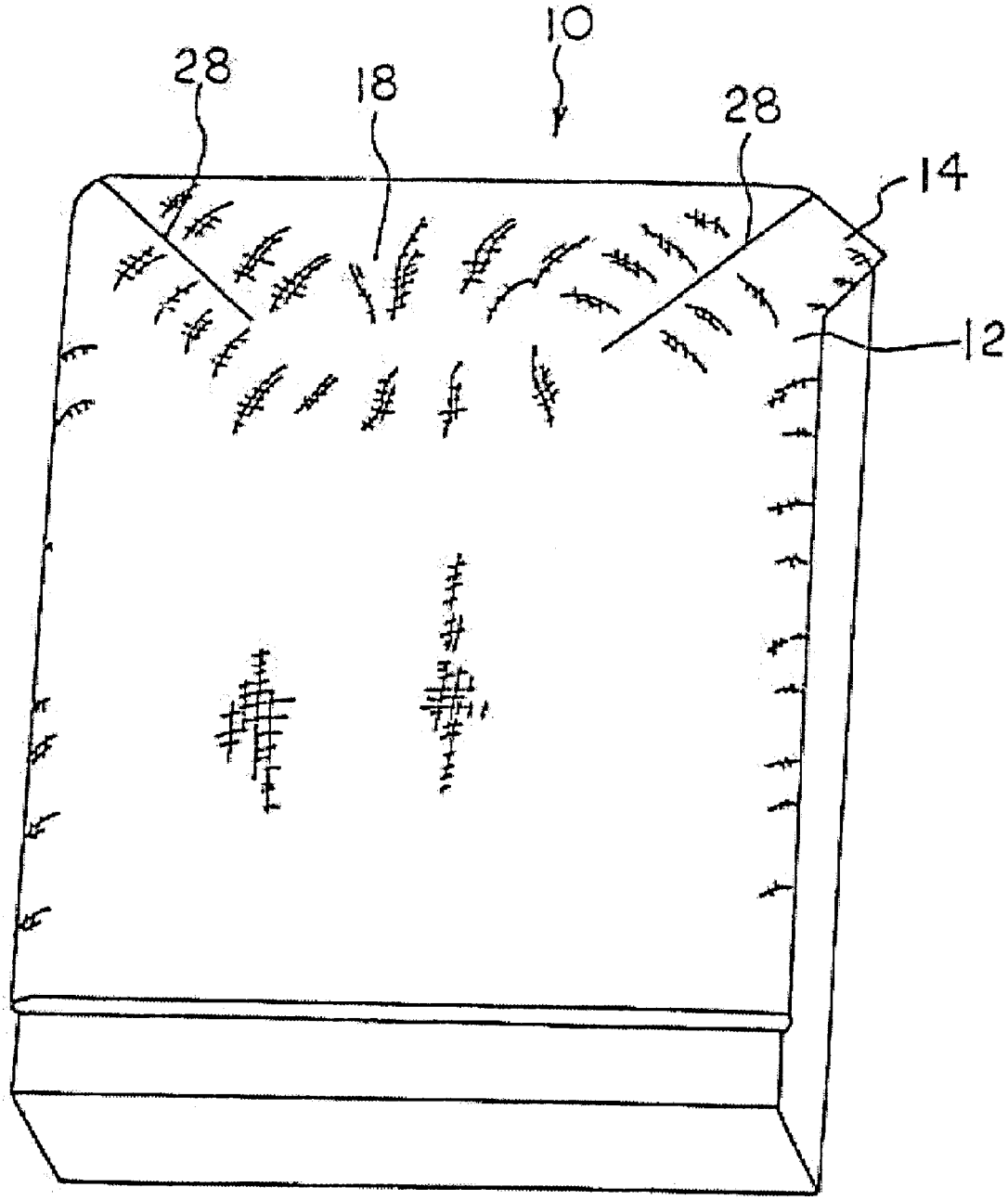
FIG. 1 is a plan view of a fitted top sheet in accordance with the present invention.
Figure 2A:
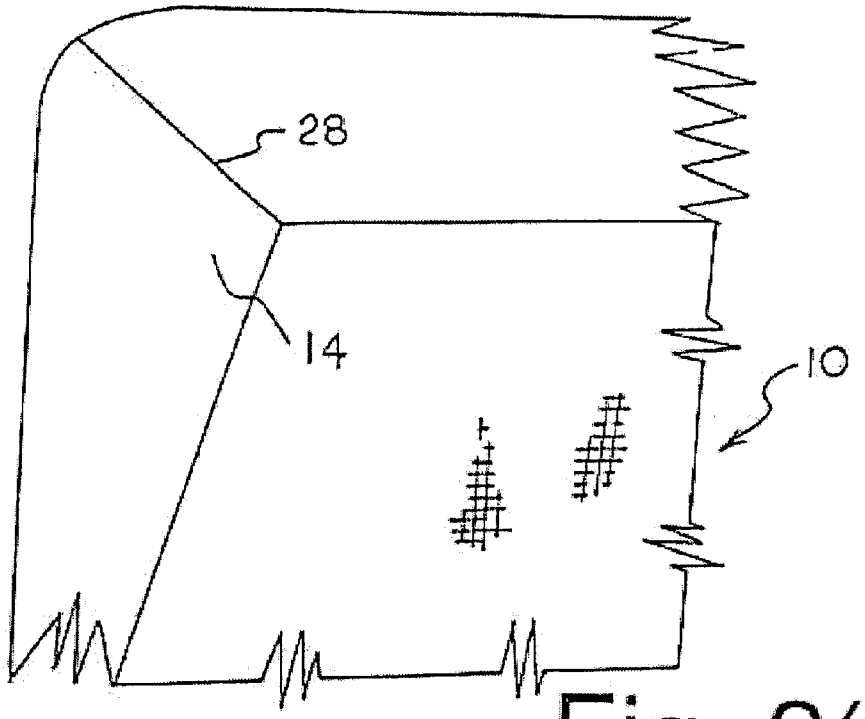
FIGS. 2(*a*) and 2(*b*) are a detail of FIG. 1, showing a toe-end corner of the sheet.
Figure 2B:
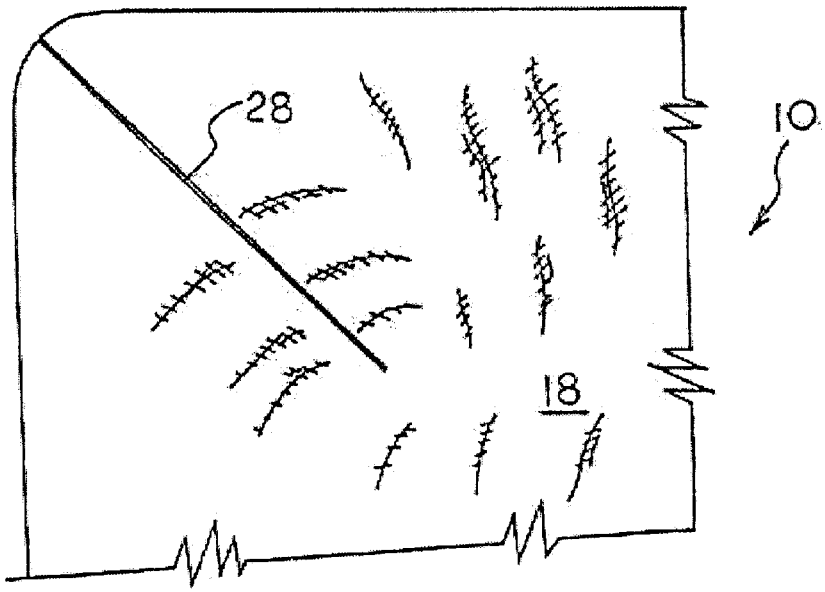
Figure 3:
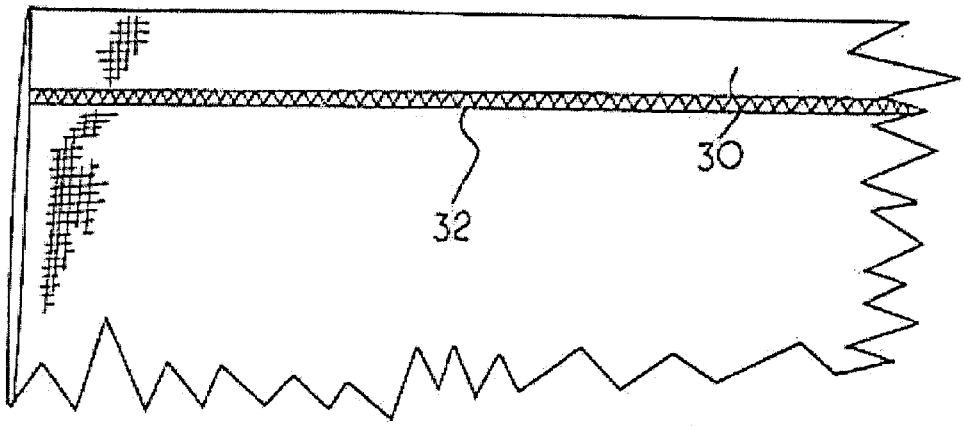
FIG. 3 is a detail, showing a portion of the head end of the sheet.
Figure 4:
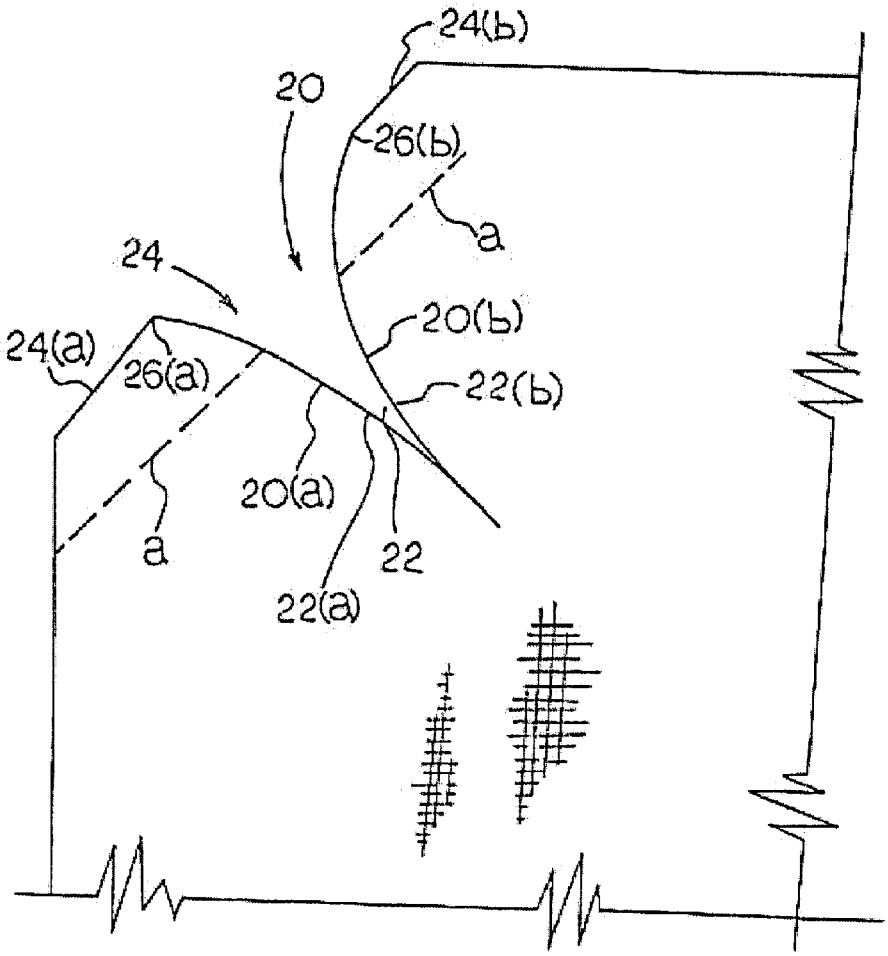
FIG. 4 is a view of a portion of a fabric blank, for fabricating a sheet according to the present invention.

The corner mattress pockets 14 and transverse flap 18 are formed within the sheet by a single deep notch 20 recessed in to each corner of the sheet, seen in the fabric blank of FIG. 4. The respective sides of the notches 20(*a*) and (*b*) are then stitched together to form the pockets and the transverse flap. As seen in FIG. 4, during fabrication of the sheet, material is removed from each corner at the toe end of a fabric blank, to form notch 20. The notch comprises a first, inner region 22 extending into the interior of the blank, merging with a second, outer region 24 at the periphery of the blank. The first region of the notch is generally narrow and deep, while the outer region flares outwardly at the mouth of the notch at a relatively shallow, broad angle. The junction between the first and second notch regions is defined by a corner 26, on either side of the notch. The notch is asymmetrical, and is formed from a first side 20(*a*) which faces the long side of the sheet, and a second side 20(*b*) which faces the midline of the sheet. Turning first to the first side 20(*a*), the inner notch region 22(*a*) has a generally straight sidewall, but flares and curves slightly outwardly as it approaches the second region 24(*a*). The second region 24(*a*) is generally straight-sided and tapers outwardly at a relatively broad, shallow angle.

The second side 20(*b*) of the notch is similar at the inner region 22(*b*) to that of the first side but which flares outwardly at its peripheral end 24(*b*) with a greater curvature than the corresponding region of the first side. The corner 26(*b*) formed between the inner and outer regions is accordingly more shallow.

The respective sides of the notch are essentially co-linear at their second peripheral regions 22(*a*) and (*b*), and form an approximate 45° angle with the sheet body.

An interior region of the first notch region 22 forms in the finished sheet the foot flap, while an exterior region of the first notch region 22 and the peripheral second region of the notch, together form the mattress pocket in the finished sheet. The national junction between these two regions of the notch is shown by line "a". The corner pockets are formed from a portion of the first notch region 22 and the second notch region 24.

The respective sides of the notch are joined by a single seam 28 extending the length of the notch. The sheet when thus stitched at both corners forms the mattress pockets 14 and foot pleat 18.

When the sheet is viewed in a flattened, non-use position, the corner seams 28 are each angled inwardly from the sheet periphery at approximately 45°. This initial seamed region forms the mattress pocket, and conveniently may be approximately 6 inches long to form a corner pocket having a sufficient depth to accommodate a typical range of mattress sizes. The seam extends further into the sheet body, angling inwardly towards the midline of the sheet and slightly forwardly towards the head end of the sheet, to form the toe pleat. The seam forms a corner of approximately 90° at the junction between the pocket and pleat.

Conveniently, the first and second seamed portions are formed from a serged stitching type, to form a stitched rib at the seam 28. In order to provide a visual indicator to inform the viewer which face of the sheet to place upwardly, the stitching is of a contrasting colour from the sheet body. For example, a sheet may have a white fabric body and bright yellow stitching, which forms a readily visible indicator on one side of the sheet.

At the head end of the sheet, a hem 30 is formed by overfolding approximately 2 inches of fabric, and placing a line of stitching 32 at the fabric edge to flatten the hem against the sheet body. Conveniently, the line of stitching is formed from a serged, raised rib, with the stitching formed from a thread of contrasting colour as described below, to serve as an additional visual indicator to the person making up a bed.

It will be seen that although the present invention has been described by way of a detailed description of a preferred embodiment of the invention, the full scope of the invention is set forth in the accompanying claims and accommodates departures from and variations to the above-described preferred embodiment.

The embodiments of the invention in which an exclusive property or privilege is claimed are defined as follows:

1. In a fitted top sheet for a bed, of the type comprising a sheet body having a toe end and a head end, corner pockets at said toe end to accommodate a mattress, and a pleat region of said sheet body extending transversely across said sheet body at said toe end to accommodate the feet of a user, the improvement comprising:

said corner pockets and pleat are each formed from only a single notch in said sheet body at each toe end corner of said sheet body, with a first notch on one lateral side of said sheet and a second notch on a second lateral side, each said notch having a narrow inner region and a widely flared peripheral region, the sides of each of said notches being joined together by a single seam extending the length of said notch.

2. A sheet as defined in claim 1, wherein within said inner region of each said notch is relatively deep and narrow, having substantially straight sides merging at the mouth of said inner region with outwardly flared, curved sides, said mouth of said inner region joining with said peripheral region of said notch, said peripheral region comprising generally straight sidewalls diverging away from each other at a relatively broad, shallow angle.

3. A bed sheet as defined in claim 2, wherein the opposed sides of said notch are dissimilar, wherein the mouth of said inner region is formed from a first relatively sharply curved side and second less sharply curved side of said notch.

4. A bed sheet as defined in claim 3, wherein said seam forms a visual indicator to indicate to the user the upper or lower side of said sheet, said visual indicator comprising said line of stitching being formed from a thread of a contrasting colour relative to said sheet body.

5. A bed sheet as defined in claim 4, wherein said sheet body is formed from a knitted, elasticized fabric.

6. A bed sheet as defined in claim 3, wherein said sheet body is formed from a knitted, elasticized fabric.

7. A bed sheet as defined in claim 2, wherein said seam forms a visual indicator to indicate to the user the upper or lower side of said sheet, said visual indicator comprising said line of stitching being formed from a thread of a contrasting colour relative to said sheet body.

8. A bed sheet as defined in claim 7, wherein said sheet body is formed from a knitted, elasticized fabric.

9. A bed sheet as defined in claim 2, wherein said sheet body is formed from a knitted, elasticized fabric.

10. A bed sheet as defined in claim 1, wherein said seam forms a visual indicator to indicate to the user the upper or lower side of said sheet, said visual indicator comprising said line of stitching being formed from a thread of a contrasting colour relative to said sheet body.

11. A bed sheet as defined in claim 10, wherein said sheet body is formed from a knitted, elasticized fabric.

12. A bed sheet as defined in claim 1, wherein said sheet body is formed from a knitted, elasticized fabric.

13. The bed sheet as defined in claim 1 further comprising a visual indicator to indicate to the user an upper and/or lower side of the bed sheet, said visual indicator comprising a seam on one side of the bed sheet, formed from stitching of a contrasting colour from said sheet body.

14. A bed sheet as defined in claim 13, wherein said line of stitching comprises a raised line of stitching forming a rib.

15. A method for fabricating a fitted top sheet for a bed the steps consisting of:

providing a fabric blank having a generally rectangular shape, having a toe end and a head end at opposed ends thereof;

cutting at each corner of said toe end, only a single notched recess, said recess defined by an interior, relatively steeply angled region, merging with a peripheral, relatively shallow-angled region;

stitching together the opposed sides of each said notch with a single seam extending the length of said notch, thereby forming within said fabric blank, a mattress pocket at each toe end corner, and a transverse pleat at said toe end to accommodate the feet of a user.

16. A method as defined in claim 15, wherein said step of forming said notch includes the step of forming at least one side of said notch, an angled corner which forms the junction between said inner and said outer regions of said notch.

17. A method as defined in claim 16, wherein said corner is formed at both sides of said notch.

18. A method as defined in claim 16, wherein the first side of the interior region of said notch flares outwardly with a relatively gentle curve adjacent to said angle, and said opposed side of said notch flares outwardly with a greater degree of curvature at a corresponding position.

19. A method as defined in claim 15, further including the step of forming said seam with a line of stitching of a colour contrasting with the colour of said sheet body.

20. A method as defined in claim 19, wherein said seam forms a rib extending upwardly from said sheet body, when said sheet body is installed on a mattress.

* * * * *

UNITED STATES PATENT AND TRADEMARK OFFICE

CERTIFICATE OF CORRECTION

PATENT NO. : 6,532,608 B2
DATED : March 18, 2003
INVENTOR(S) : Schreiner

It is certified that error appears in the above-identified patent and that said Letters Patent is hereby corrected as shown below:

Title page,
Insert Item:
-- [30] Foreign Application Priority Data
Mar. 10, 2000 (CA)……..2,300,658 --.

Item [56], References Cited, U.S. PATENT DOCUMENTS,
"2,697,056" should read -- 2,679,056 --.

Column 1,
Line 7, "users feet" should read -- user's feet --.

Signed and Sealed this

Second Day of September, 2003

JAMES E. ROGAN
*Director of the United States Patent and Trademark Office*